US012723836B2

(12) United States Patent
Vanek

(10) Patent No.: US 12,723,836 B2
(45) Date of Patent: Sep. 1, 2026

(54) ADJUSTABLE STOCK SYSTEMS FOR WEAPONS

(71) Applicant: Vantac Technologies LLC, Darby, MT (US)

(72) Inventor: Joede Thomas Vanek, Florence, MT (US)

(73) Assignee: Vantac Technologies LLC, Darby, MT (US)

( * ) Notice: Subject to any disclaimer, the term of this patent is extended or adjusted under 35 U.S.C. 154(b) by 0 days.

(21) Appl. No.: 18/898,101

(22) Filed: Sep. 26, 2024

(65) Prior Publication Data

US 2025/0102269 A1 Mar. 27, 2025

Related U.S. Application Data

(60) Provisional application No. 63/540,839, filed on Sep. 27, 2023.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/20; F41C 23/14; F41A 11/04
USPC ..... 42/75.03, 73, 71.01
See application file for complete search history.

(56) References Cited

U.S. PATENT DOCUMENTS

| | | | | |
|---|---|---|---|---|
| 964,419 | A * | 7/1910 | Giusto | F41A 9/05 89/158 |
| 1,031,428 | A * | 7/1912 | D'Ubaldo | F41A 9/18 42/71.01 |
| 3,282,165 | A * | 11/1966 | Maillard | F41A 19/31 89/190 |
| 3,795,998 | A | 3/1974 | Kuhl | |
| 7,984,580 | B1 * | 7/2011 | Giauque | F41C 23/06 42/74 |
| 8,196,328 | B2 * | 6/2012 | Simpkins | F41C 27/20 42/114 |
| 8,991,088 | B1 * | 3/2015 | Young | F41C 23/04 42/75.03 |
| 9,429,387 | B1 * | 8/2016 | Barfoot | F41C 23/20 |
| 10,788,287 | B2 | 9/2020 | Parker et al. | |
| 10,928,159 | B2 * | 2/2021 | Vanek | F41C 23/20 |
| 11,592,263 | B2 * | 2/2023 | Vanek | F41C 23/14 |
| 11,740,041 | B2 * | 8/2023 | Vanek | F41C 23/20 89/199 |
| 11,965,708 | B2 | 4/2024 | Mebberson | |
| D1,069,016 | S * | 4/2025 | Kielsmeier | D21/573 |
| D1,085,314 | S * | 7/2025 | Kielsmeier | D22/104 |

(Continued)

OTHER PUBLICATIONS

United States Patent and Trademark Office Non-Final Office Action issued Jan. 5, 2026, cited in related U.S. Appl. No. 19/007,515.

*Primary Examiner* — Michael D David
(74) *Attorney, Agent, or Firm* — Troutman Pepper Locke LLP; Gabrielle L. Gelozin

(57) ABSTRACT

A stock system for weapons and/or other suitable devices can include a stock. The stock system can also include a moveable assembly within the stock that has one or more moveable components configured to move relative to the stock. The moveable assembly can include a rack and pinion assembly configured to bias a buttpad toward an extended position.

20 Claims, 5 Drawing Sheets

(56) References Cited

U.S. PATENT DOCUMENTS

| | | | | |
|---|---|---|---|---|
| 2004/0007124 | A1* | 1/2004 | Nakatani | F41A 25/24<br>89/196 |
| 2011/0283584 | A1* | 11/2011 | Walters | F41C 23/14<br>42/73 |
| 2013/0340312 | A1* | 12/2013 | Fulton | F41C 23/10<br>42/73 |
| 2018/0120055 | A1* | 5/2018 | Silverman | F41C 23/14 |
| 2019/0195595 | A1* | 6/2019 | Kielsmeier | F41C 33/08 |
| 2020/0200505 | A1* | 6/2020 | Brown, Jr. | F41C 27/00 |
| 2022/0299293 | A1 | 9/2022 | Mebberson | |
| 2023/0204323 | A1* | 6/2023 | Ludlow | F41C 23/14<br>42/73 |
| 2025/0010269 | A1 | 1/2025 | Oh et al. | |
| 2025/0102269 | A1* | 3/2025 | Vanek | F41C 23/04 |
| 2025/0216172 | A1* | 7/2025 | Vanek | F41C 23/04 |

* cited by examiner

ADJUSTABLE STOCK SYSTEMS FOR WEAPONS

CROSS-REFERENCE TO RELATED APPLICATIONS

This application claims priority to and the benefit of U.S. Provisional Application No. 63/540,839, filed Sep. 27, 2023, the entire contents of which are herein incorporated by reference in their entirety.

STATEMENT OF GOVERNMENT RIGHTS

This invention was made with government support under contract no. (identify the contract) awarded by the (identify the Federal agency). The government has certain rights in the invention.

FIELD

This disclosure relates to adjustable stock systems for weapons.

BACKGROUND

Certain weapons (e.g., firearms, airsoft guns, cross-bows, etc.) can have an adjustable stock system. Traditionally, these systems have required a user to remove a hand from a weapon and actuate a movable component. This causes loss of grip, loss of cheek weld, a loss of sight picture, and overall loss of control of the weapon while a hand is removed from the weapon.

Such conventional methods and systems have generally been considered satisfactory for their intended purpose. However, there is still a need in the art for improvements. This disclosure provides a solution for this need.

SUMMARY

In accordance with at least one aspect of this disclosure, a stock system for weapons and/or other suitable devices can include a stock. The stock system can also include a moveable assembly within the stock that has one or more moveable components configured to move relative to the stock. The moveable assembly can include a rack and pinion assembly configured to bias a buttpad toward an extended position.

In certain embodiments, the system can include a mounting box disposed within or defined by the stock to define an interior cavity at least partially containing the moveable assembly. In certain embodiments, the rack and pinion assembly can include a rack configured to be connected, directly or indirectly, to a buttpad. In certain embodiments, the rack and pinion assembly can include a gear within the mounting box and configured to be meshed with the rack. In certain embodiments, at least one of the gear or the rack can be biased to actuate a buttpad toward the extended position.

In certain embodiments, the gear can be pinned to the mounting box to rotate relative to the mounting box. In certain embodiments, the gear can be biased to urge the rack to the extended position by a constant force spring mounted to the stopping block.

In certain embodiments, the rack can include rack teeth on at least a side of the rack configured to abut and mesh with the gear. In certain embodiments, the rack can include latch teeth on a latch side of the rack.

In certain embodiments, the system can include a rod configured to be connected to the buttpad and move with the rack. In certain embodiments, the system can include a stopping block disposed within the mounting box and attached to the mounting box. In certain embodiments, the rod and/or the rack form a catch interface configured to catch the stopping block to limit extension of the buttpad. In certain embodiments, the rod and rack are connected at a distal end to form the catch interface.

In certain embodiments, the system can include a mounting plate configured to enclose the mounting box and/or guide the rack and/or rod. In certain embodiments, the system can include an actuator and a latch configured to be actuated by the actuator to move between a latched position engaged with the rack and pinion assembly to hold the rack and pinion assembly, and an unlatched position disengaged from the rack and pinion assembly.

In certain embodiments, the actuator can be connected to a connector member configured to transfer force from the actuator. In certain embodiments, the stock can include a connector member channel, wherein the connector member is disposed within and/or travels inside the connector member channel within the stock to operatively connect to the latch.

In certain embodiments, the latch can include a latch assembly comprising a first member configured to be moved by the connector member, and a second member configured to move relative to the first member between a latched position engaged with the rack and pinion assembly, and a second position disengaged from the rack and pinion assembly. In certain embodiments, the latch assembly can be the same or similar to a latch assembly as shown and/or described in U.S. Pat. No. 10,928,159 (e.g., FIGS. 49-65 thereof), incorporated by reference herein in its entirety.

In certain embodiments, the stock can be a fixed stock for a long rifle and/or includes a curved shape and a rear portion. In certain embodiments, the actuator can be positioned such that the user can actuate the actuator with a digit without removing the users hand from the device to which the stock system is mounted.

In accordance with at least one aspect of this disclosure, a firearm can include a trigger assembly, and a stock system connected to the trigger assembly. The stock system can be or include any suitable embodiment of a stock system disclosed herein. In certain embodiments, the stock can be single piece fixed stock mounted to the trigger assembly.

In accordance with at least one aspect of this disclosure, a device can include a trigger assembly, and stock system connected to the trigger assembly. The stock system can be or include any suitable embodiment of a stock system disclosed herein. In certain embodiments, the rack and pinion assembly can be biased by at least a constant force spring.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
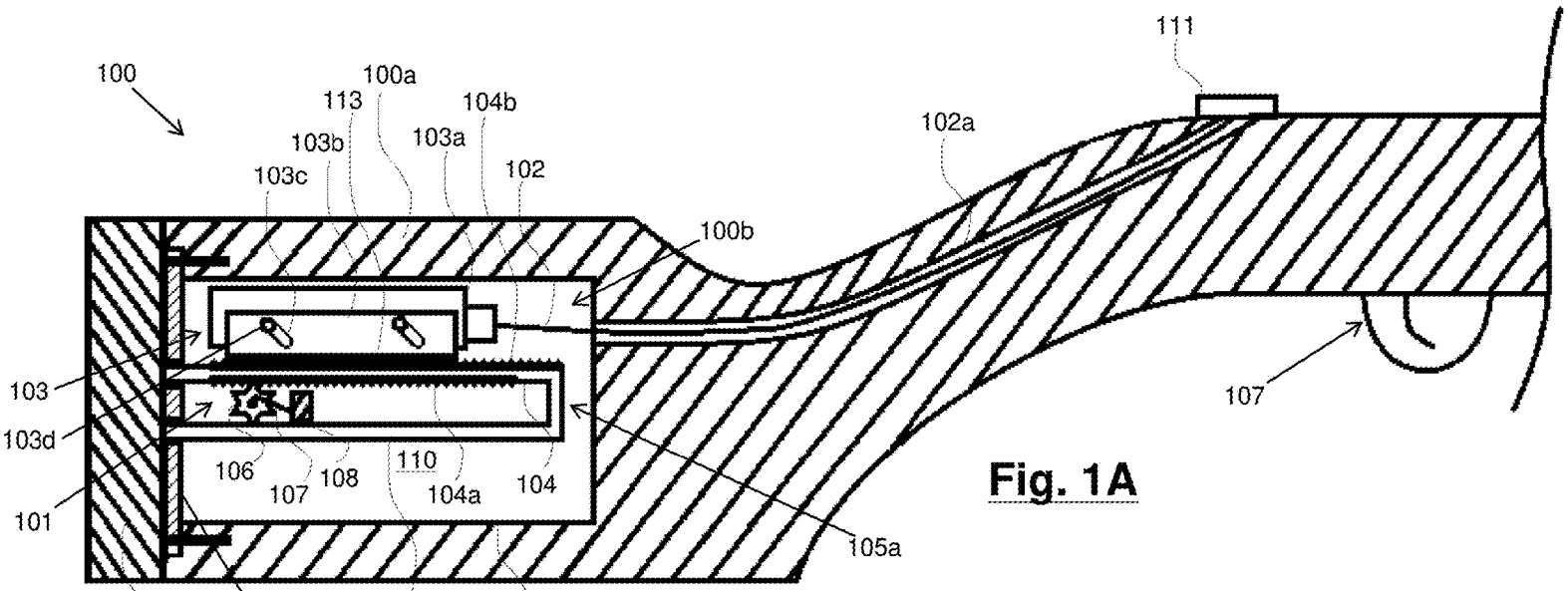
FIG. 1A is a schematic cross-sectional view of an embodiment of a stock system in accordance with this disclosure, shown in a collapsed position and a latched position.

Reference will now be made to the drawings wherein like reference numerals identify similar structural features or aspects of the subject disclosure. For purposes of explanation and illustration, and not limitation, an illustrative view of an embodiment of an adjustable stock system in accordance with the disclosure is shown in FIGS. 1A and 1*s* designated generally by reference character 100. Other views, embodiments, and/or aspects of this disclosure are illustrated in FIGS. 1B-5C. Certain embodiments described herein can be used to provide length of pull adjustment without hand removal from a weapon (e.g., a long rifle having a fixed/overhand grip).

Figure 1B:
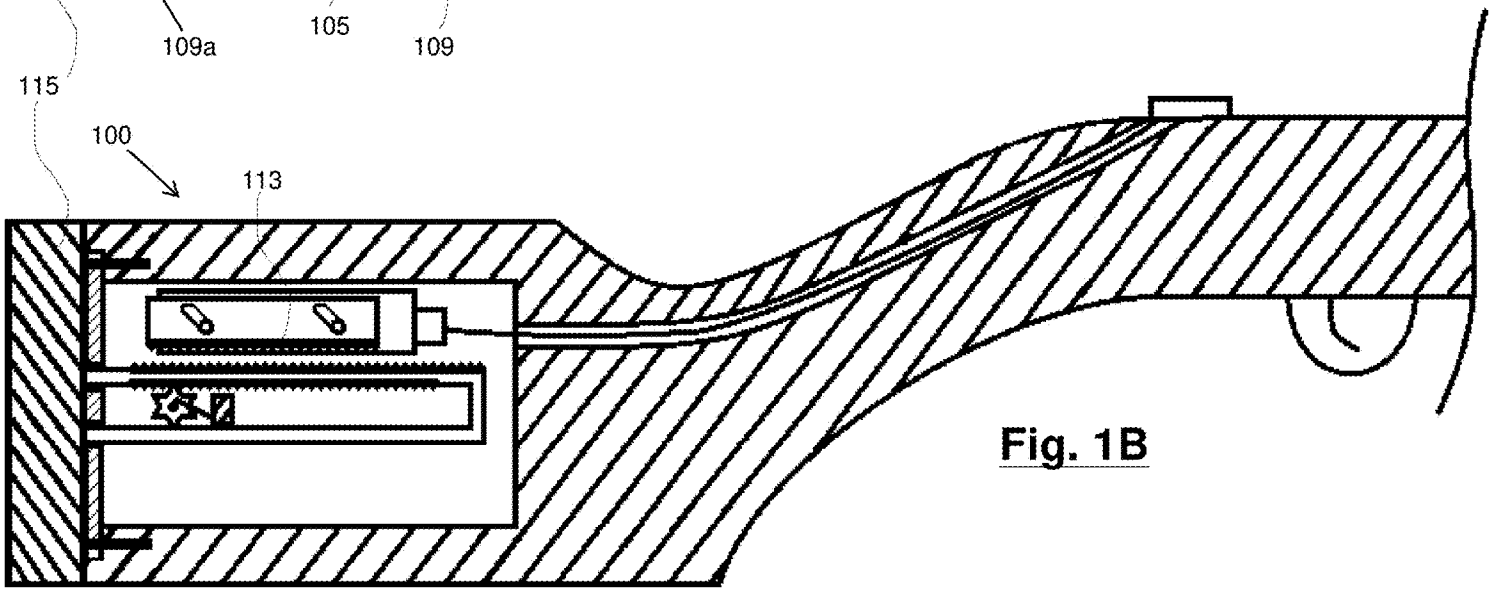
FIG. 1B is a schematic cross-sectional view of the embodiment of FIG. 1A, shown in a collapsed position and an unlatched (e.g., actuated) position.
Figures 3A, 3B, 3C:
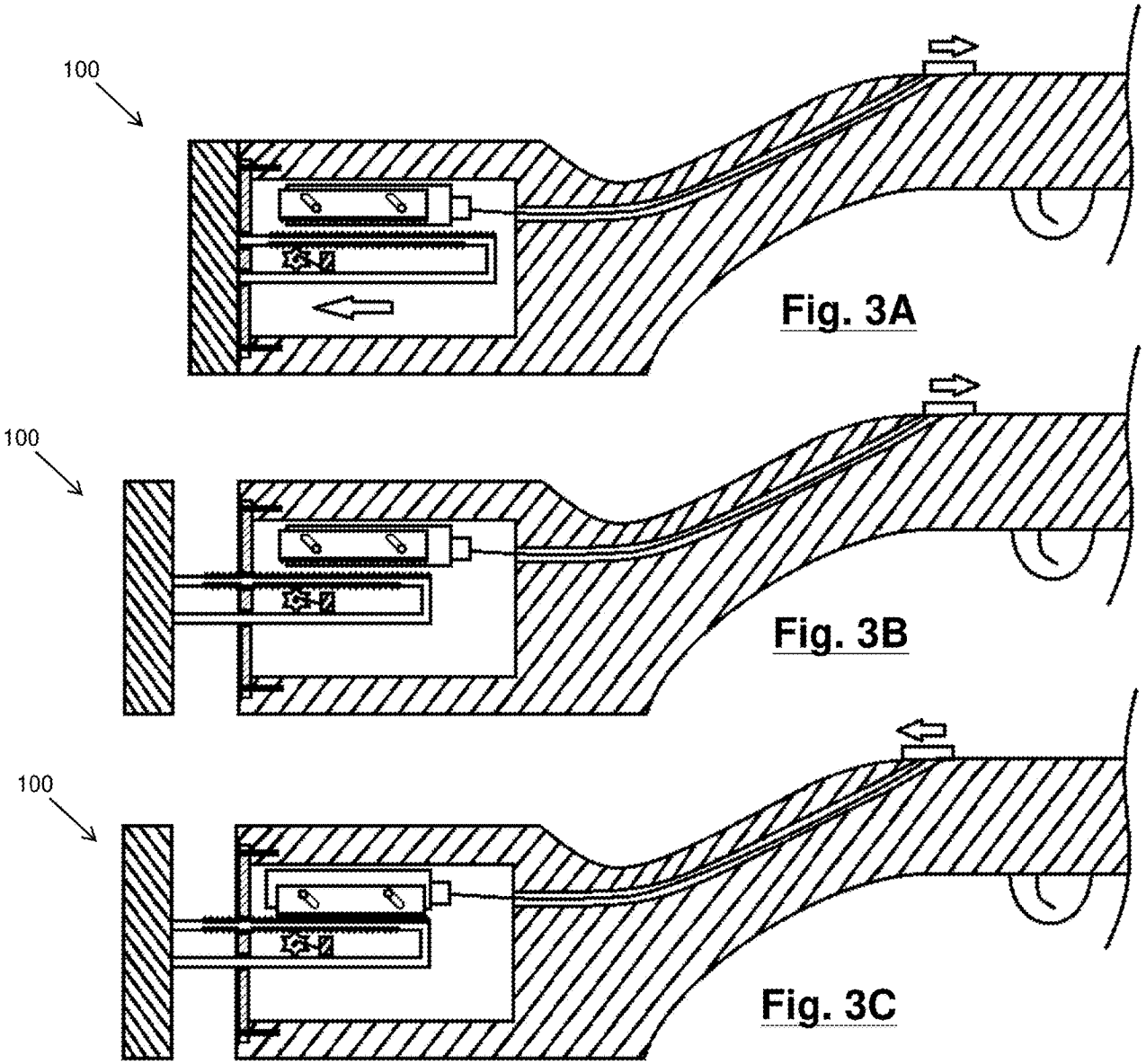
FIG. 3A is a schematic cross-sectional view of the embodiment of FIG. 1A, shown in a collapsed position and with the latch in an unlatched (e.g., actuated) position, and depicting forward force on an embodiment of an actuator and rearward force and/or motion of an embodiment of a rack attached to an embodiment of a buttpad.
FIG. 3B is a schematic cross-sectional view of the embodiment of FIG. 3A, shown in a partially extended position and with the latch in an unlatched (e.g., actuated) position, and depicting forward force on the actuator with the rack and buttpad being held in position (e.g., with a force equal to bias acting on the rack and/or buttpad and/or other connected component).
FIG. 3C is a schematic cross-sectional view of the embodiment of FIG. 3B, shown in the partially extended position, and depicting a rearward force (e.g., due to a bias) on the actuator moving the latch to the latched position to latch the rack and buttpad in the partially extended position.
Figures 4A, 4B, 4C:
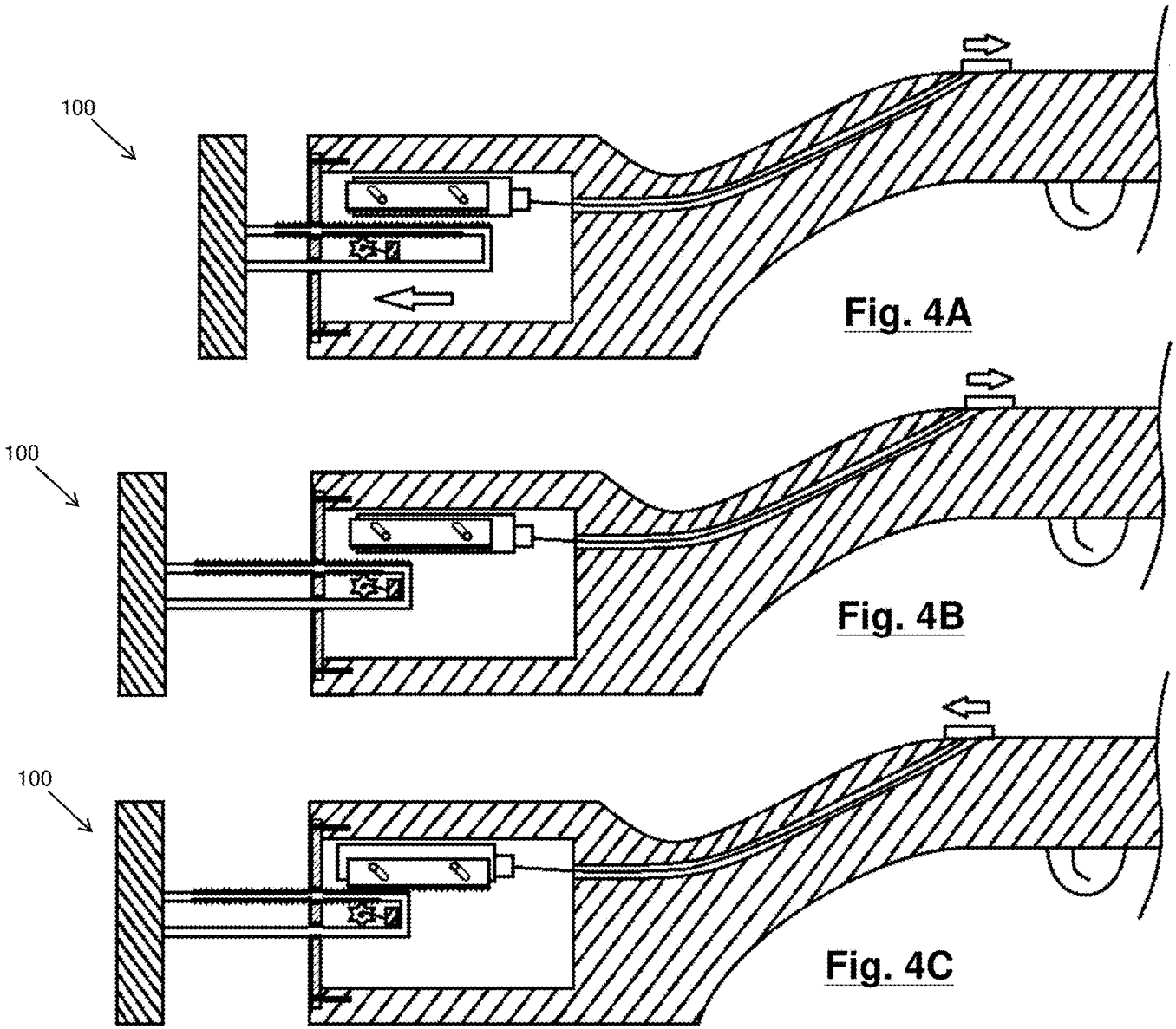
FIG. 4A is a schematic cross-sectional view of the embodiment of FIG. 1A, shown in the partially extended position with the latch in an unlatched (e.g., actuated) position, and depicting forward force on the actuator and rearward force and/or motion of the rack attached to the buttpad.
FIG. 4B is a schematic cross-sectional view of the embodiment of FIG. 4A, shown in a fully extended position and with the latch in an unlatched (e.g., actuated) position, and depicting forward force on the actuator with the rack and buttpad being held in position by an embodiment of a stopping block interacting with the rack and/or an embodiment of a rod.
FIG. 4C is a schematic cross-sectional view of the embodiment of FIG. 4B, shown in the fully extended position, and depicting a rearward force (e.g., due to a bias) on the actuator moving the latch to the latched position to latch the rack and buttpad in the fully extended position.
Figures 5A, 5B, 5C:
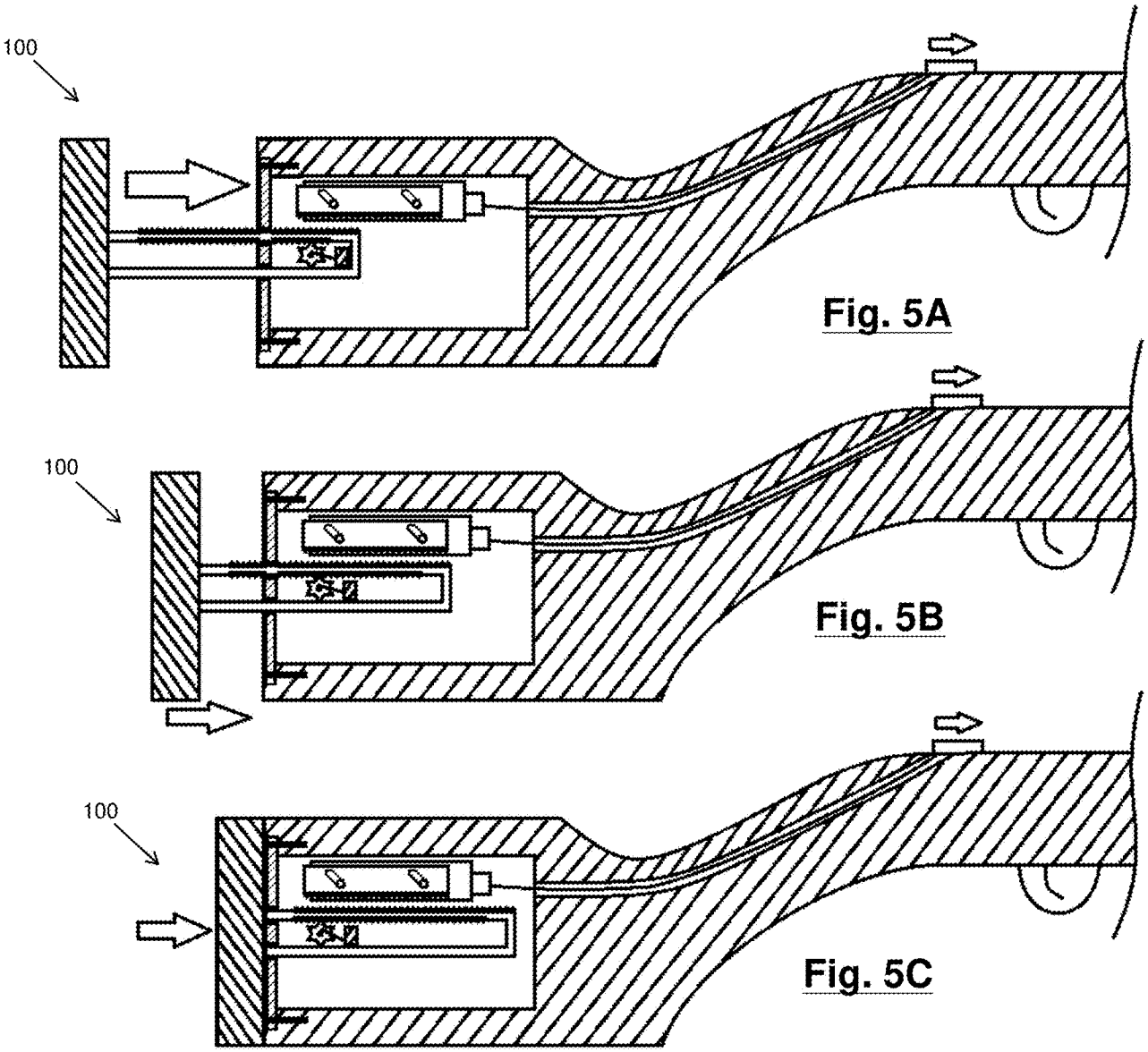
FIG. 5A is a schematic cross-sectional view of the embodiment of FIG. 1A, shown in the fully extended position with the latch in an unlatched (e.g., actuated) position, and depicting forward force on an embodiment of an actuator and forward force on the buttpad and/or motion of the rack attached to the buttpad.
FIG. 5B is a schematic cross-sectional view of the embodiment of FIG. 5A, shown in a partially extended position and with the latch in an unlatched (e.g., actuated) position, and depicting forward force on the actuator and forward force on the buttpad and/or motion of the rack attached to the buttpad.
FIG. 5C is a schematic cross-sectional view of the embodiment of FIG. 5B, shown in the collapsed position, and depicting forward force on the actuator and forward force on the buttpad.

In accordance with at least one aspect of this disclosure, referring to FIGS. 1A and 1B, a stock system 100 for weapons and/or other suitable devices can include a stock 100*a*. The stock system 100 can also include a moveable assembly 100*b* within the stock that has one or more moveable components configured to move relative to the stock 100*a*. The moveable assembly 100*b* can include a rack and pinion assembly 101 configured to bias a buttpad 115 toward an extended position (e.g., as shown in FIGS. 3C and 4C).

In certain embodiments, the system 100 can include a mounting box 109 disposed within or defined by the stock 100*a* to define an interior cavity 110 at least partially containing the moveable assembly 100*b* (e.g., enclosing all parts in the collapsed position, and enclosing all but a portion of a support structure, e.g., a rack and/or rod as disclosed herein, in an extended position). The mounting box 109 can have any suitable shape, e.g., a rectangular shape, a circular cross-section, or any other suitable shape for containing components as disclosed herein.

In certain embodiments, the rack and pinion assembly 101 can include a rack 104 configured to be connected, directly or indirectly, to a buttpad 115. In certain embodiments, the rack and pinion assembly 101 can include a gear 106 within the mounting box 109 and configured to be meshed with the rack 104 (e.g., rack teeth 104*a* thereof). In certain embodiments, at least one of the gear 106 or the rack 104 can be biased to actuate a buttpad 115 toward the extended position (e.g., the fully extended position shown in FIG. 4C).

In certain embodiments, the gear 106 can be pinned to the mounting box 109 (e.g., interior lateral walls forming the cavity 110) to rotate relative to the mounting box 109. In certain embodiments, the gear 106 can be biased to urge the rack 104 to the extended position, e.g., by a biasing member 107 (e.g., a rotational constant force spring). In certain embodiments, the system 100 can include a stopping block 108 (e.g., of any suitable shape) disposed within the mounting box 109 and attached to the mounting box 109.

Figure 2A:
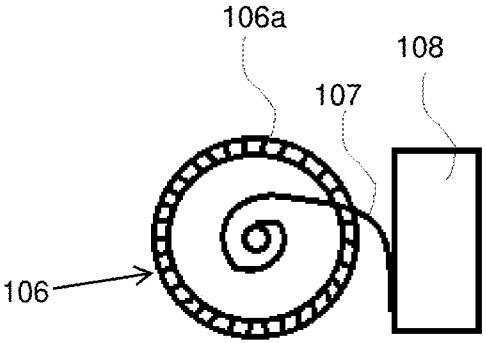
FIG. 2A shows a schematic elevation of an embodiment of a gear of a rack and pinion assembly, shown biased with a constant force spring interfacing with a stopping block.
Figure 2B:
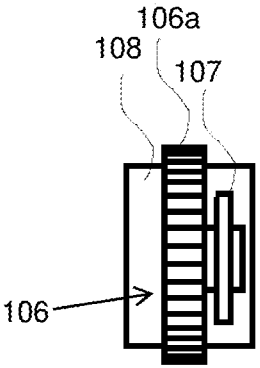
FIG. 2B shows a rear elevation view of the embodiment of FIG. 2A, perpendicular to the view of FIG. 2A.

As shown in FIGS. 2A and 2B, the biasing member 107 can be a constant force spring mounted to the stopping block 108. For example, the biasing member 107 can be wrapped around the gear 106 to bias the gear counter clockwise in the orientation shown in FIG. 2A. It is noted that the gear 106, biasing member 107, and stopping block 108 are all shown schematically and not necessarily to scale, and can be embodied differently to provide a desired function. Other arrangements are contemplated herein. In certain embodiments, the rack 104 can be directly biased with a coil spring or other suitable member between the stock 100*b* and the rack 104.

In certain embodiments, the rack 104 can include rack teeth 104*a* on at least a gear side of the rack 104 configured to abut and mesh with the gear 106 (e.g., with gear teeth 106*a* of the gear 106). The rack teeth 104*a* can be on an inner (e.g., downward) surface of the rack 104. In certain embodiments, e.g., as shown, the rack 104 can include rack latch teeth 104*b* on a latch side of the rack 104 (e.g., facing a latch 103). The rack latch teeth 104*a* can be on an outer (e.g., upper) surface of the rack 104. The rack latch teeth 104*a* can extend the entire length of the outer (e.g., upper) surface of the rack 104, or any other suitable portion to allow desired contact over the stroke length of the rack and pinion assembly 101.

The rack teeth 104*a* can be the same as or different than the rack latch teeth 104*b*. The rack latch teeth 104*b* can be configured to mesh with or otherwise interact with latch teeth 113 of the latch 103. The fineness of the latch teeth 104*b* and corresponding latch teeth 113 can define how many extension positions of the buttpad there are and a distance between such positions.

In certain embodiments, the system 100 can include a rod 105 configured to be connected to the buttpad 115 and to move with the rack 104. In certain embodiments, the rod 105 and/or the rack 104 can form a catch interface 105*a* (e.g., a connected portion, two ends near each other, or any other suitable structure or protrusion) configured to catch the stopping block 108 to limit extension of the buttpad 115. In certain embodiments, the rod 105 and rack 104 can be connected at a distal end (e.g., the right end as shown) to form the catch interface 105, e.g., as shown. In certain embodiments, the rack 104 and rod 105 can be separate components that are otherwise unconnected directly. The rack 104 and/or rod 105 can include any suitable cross-sectional shape. In certain embodiments, the system 100 can include a mounting plate 109*a* configured to enclose the mounting box 109 and/or guide the rack 104 and/or rod 105 (e.g., via guide holes defined therethrough, e.g., as shown).

In certain embodiments, the rack 104 and/or rod 105 and/or the catch interface 105*a* can be directly biased with a coil spring or other suitable biasing member (e.g., a constant force spring) between the stock 100*b* and the rack 104. While a constant force spring (e.g., on the gear 106 or in other suitable location) can provide smooth operation and constant feedback for a user, any other suitable type, number, and location of biasing members are contemplated herein.

In certain embodiments, the system 100 can include an actuator 111 and a latch 103 configured to be actuated by the actuator 111 to move between a latched position (e.g., as shown in FIG. 1A) engaged with the rack and pinion assembly 101 to hold the rack and pinion assembly 101, and an unlatched position (e.g., as shown in FIG. 1B) disengaged from the rack and pinion assembly 101. In certain embodiments, the actuator 111 can be connected to a connector member 102 configured to transfer force from the actuator 111 to the latch 103. In certain embodiments, the stock 100*a* can include a connector member channel 102*a*. The connector member 102 can be disposed within and/or travel inside of the connector member channel 102*a* within the stock 100*a* to operatively connect to the latch 103.

In certain embodiments, the latch 103 can include a latch assembly having a first member 103*a* configured to be moved by the connector member 102, and a second member 103*b* configured to move relative to the first member 103*a* between the latched position engaged with the rack and pinion assembly 101 (e.g., as shown in FIG. 1A), and the unlatched position disengaged from the rack and pinion assembly 101 (e.g., as shown in FIG. 1B). In certain embodiments, the latch 103 can be or include a latch assembly that is the same or similar to a latch assembly as shown and/or described in U.S. Pat. No. 10,928,159 (e.g., FIGS. 49-65 thereof), incorporated by reference herein in its entirety. The second member 103*b* can include the latch teeth 113 on an inner (e.g., downward) surface thereof to engage with the rack latch teeth 104*b*. As shown, the first member 103*a* can be constrained (e.g., with any suitable structure) to sliding motion (e.g., horizontal as shown) actuated by the connector member 102 (e.g., to pull the first member 103*a* forward), and the second member 103*b* can be constrained to sliding motion (e.g., orthogonal and/or vertical motion) as well as cammed (e.g., by virtue of angled cam slots 103*c* of the second member 103*b* being forced by cam pins 103*d* of the first member 103*a*) to move between the latched and unlatched positions. A third component (not shown) can be mounted to the mounting box 109, can include linear horizontal slots to receive the pins 103*d* and for constraining the motion of the first member 103*a*, and can house the second member 103*b* to constrain motion of the second member to vertical motion (or and other desired constrained motion relative to the first member 103*a*).

In certain embodiments, the stock 100*b* can be a fixed stock for a long rifle (e.g., as shown) and/or includes a curved shape and a rear portion. Any other suitable type of stock for any suitable type of firearm, weapon, or other sighted device is contemplated herein. In certain embodiments, the actuator 111 can be positioned such that the user can actuate the actuator 111 with a digit (e.g., a thumb) without removing the user's hand from the device to which the stock system 100 is mounted (and/or without removing a finger from the trigger and/or without losing cheek weld).

In accordance with at least one aspect of this disclosure, a firearm can include a trigger assembly 117, and a stock system connected to the trigger assembly 117. The stock system can be or include any suitable embodiment of a stock system 100 disclosed herein, e.g., as described above. In certain embodiments, the stock 100*b* can be single piece fixed stock mounted to the trigger assembly 117 (e.g., as shown in FIG. 1A).

In accordance with at least one aspect of this disclosure, a device (e.g., a firearm, a weapon, or other suitable device) can include a trigger assembly 107, and stock system connected to the trigger assembly. The stock system can be or include any suitable embodiment of a stock system 100 disclosed herein. In certain embodiments, the rack and pinion assembly 101 can be biased by at least a constant force spring. Other suitable biasing members in addition to one or more constant force springs, are contemplated herein.

Embodiments disclosed herein can include a stock system 100 having a stock 100*a*. In certain embodiments, the stock 100*a* can be a fixed stock for a long rifle (e.g., as shown) having a curved shape and a rear portion. Any other suitable stock type for any suitable firearm or other suitable devices are contemplated herein. The stock 100*a* can be made of any suitable number of components (e.g., a single piece, multiple pieces).

The system 100 can include a moveable assembly 100*b* within the stock 100*a* that has one or more moveable components configured to move relative to the stock 100*a*. The movable assembly 100*b* can include an actuator 111 (e.g., a flush mounted slidable or rotatable or pressable or pullable button that can be positioned to be actuated by a thumb of a user without having to move a user's hand off of the weapon or lose sight picture, cheek weld, etc.). The actuator 111 can be connected to a connector member 102 (e.g., a cable, a rod, a series of linkages, etc.) configured to transfer force from the actuator 111. The connector member 102 can be disposed within and/or travel inside a connector member channel 102*a* within the stock 100*a* (e.g., to a cavity defined by a mounting box 109 disclosed below).

The moveable assembly 100*b* can include a latch 103 connected to the connector member 102 to be actuated by the connector member 102 (e.g., by being pulled). In certain embodiments, the moveable assembly 100*b* can include a rack 104 (e.g., a toothed adjustment rack). In certain embodiments, the moveable assembly 100*b* can include a rod 105 (e.g., a stabilizing rod). As shown, the latch 103 can include teeth on a bottom configured to engage with teeth on the rack 104. In certain embodiments, the latch 103 can be or include one or more embodiments of a latch assembly as shown and/or described in U.S. Pat. No. 10,928,159, incorporated by reference herein in its entirety. In this regard, in certain embodiments, when the connector member 102 moves a first component of the latch assembly, it is cammed by a second component of the latch assembly (e.g., with the teeth) to lift up and/or away from the rack 104 such that the teeth disengage allowing the rack 104 to translate (e.g., urged by a bias).

In certain embodiments, a butt pad 115 can be attached (directly or indirectly) to the rack 104. In certain embodiments, the butt pad 115 can also be attached to the rod 105. The rack 104 and rod 105 can be configured to slide between a collapse position (e.g., as shown) and an extended position (in a rearward direction toward the user), and the butt pad 115 can move with the rack 104 and the rod 105.

In certain embodiments, the moveable assembly 100*b* can include a gear 106 pinned relative to the stock 100*a* and configured to rotate to engage with teeth of the rack 104. The gear 106 can be engaged with a spring 107 (e.g., a spiral spring and/or a constant force spring) configured to bias the gear in a direction to bias the toothed engagement member 104 toward an extended position. The spring 107 can be mounted to a fixed location (e.g., a plate, the stopping block 108, or any other suitable location) at one end, and to the gear 106 at another to rotationally bias the gear 106. Other suitable spring arrangements are contemplated herein. In this regard, the gear 106 can push adjustment rack 104 out of the stock 100*a* when the latch 103 is in an unengaged position from the rack 103.

The system 100, the stock 100*a*, and/or the moveable assembly 100*b* can include a stopping block 108 configured to limit motion of the rack 104 or rod 105 (e.g., which can have an L shape or other suitable shape to engage the stopping block 108 when moved to the maximum extended position (e.g., defining a length of pull of about 10 inches to about 15 inches in certain embodiments).

The system 100 can include a mounting box 109. The mounting box 109 can be defined by the stock 100*a* and/or be or include an insertable box or portion thereof. The mounting box 109 can contain one or more components of the moveable assembly 100*b*, e.g., as shown. The system 100 can include a mounting plate 109*a* configured to mount over the mounting box 109 with one or more fasteners 109*b* (e.g., screws) to enclose the mounting box 109 and/or fix it to the stock 100*a* (e.g., if it is a separate assembly). In certain embodiments, the mounting plate 109*a* can include a conforming hole for each of the toothed rack 103 and the rod 104 to slide through, and can thus guide and limit the motion thereof to sliding motion. Any other suitable passageway or transmission through the mounting plate 109*a* is contemplated herein.

In certain embodiments, the moveable components can be entirely contained within the fixed stock 100*a* and can provide easy length of pull adjustment without requiring a user to lose their view through the scope or otherwise take their hands off of the weapon (or trigger). A user can actuate the actuator 111 with a thumb of their firing hand, for example, and allow the spring action of the gear 106 to move the butt pad 115 outwardly or apply pressure to the butt pad 115 to push the assembly inward against the force of the spring 107. The actuator 111 can be held while motion is desired, and released when a lock is desired. The teeth in the assembly can be arranged and have any suitable number/size thereof to allow any suitable number of positions of locking. FIG. 2A shows a side view of the embodiment of a gear 106. FIG. 2B shows a rear view of the embodiment of a gear 106.

Those having ordinary skill in the art understand that any numerical values disclosed herein can be exact values or can be values within a range. Further, any terms of approximation (e.g., "about", "approximately", "around") used in this disclosure can mean the exact stated value and the stated value within a range. For example, in certain embodiments, for the stated values disclosed herein, the range is within (plus or minus) 20% of the stated value. In certain embodiments of the stated values disclosed herein, the range is within (plus or minus) 10% of the stated value. In certain embodiments, for the stated values disclosed herein, the range is within (plus or minus) 5% of the stated value. In certain embodiments, for the stated values disclosed herein, the range is within (plus or minus) 2% of the stated value. In certain embodiments, for the stated values disclosed herein, the range is within (plus or minus) 1% of the stated value. In certain embodiments, for the stated values disclosed herein, the range is within (plus or minus) 0.5% of the stated value. In certain embodiments, for the stated values disclosed herein, the range is within (plus or minus) 0.25% of the stated value. In certain embodiments, for the stated values disclosed herein, the range is within (plus or minus) 0.1% of the stated value. In certain embodiments, for the stated values disclosed herein, the range is within (plus or minus) 0.05% of the stated value. In certain embodiments, for the stated values disclosed herein, the range is within (plus or minus) 0.01% of the stated value. In certain embodiments, for the stated values disclosed herein, the range is within (plus or minus) 0.001% of the stated value. In certain embodiments, for the stated values disclosed herein, the range is within any other suitable percentage or number as appreciated by those having ordinary skill in the art (e.g., for known tolerance limits or error ranges). In certain embodiments, any combination of the above ranges for any combination of stated values are contemplated herein.

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or"

as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of this disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A stock system for weapons and/or other suitable devices, comprising:
- a stock; and
- a moveable assembly within the stock that has one or more moveable components configured to move relative to the stock, the moveable assembly comprising a rack and pinion assembly configured to bias a buttpad toward an extended position.

2. The system of claim 1, further comprising a mounting box disposed within or defined by the stock to define an interior cavity at least partially containing the moveable assembly.

3. The system of claim 2, wherein the rack and pinion assembly includes:
- a rack configured to be connected, directly or indirectly, to a buttpad; and
- a gear within the mounting box and configured to be meshed with the rack, wherein at least one of the gear or the rack are biased to actuate a buttpad toward the extended position.

4. The system of claim 3, wherein the gear is pinned to the mounting box to rotate relative to the mounting box.

5. The system of claim 4, wherein the rack includes rack teeth on at least a side of the rack configured to abut and mesh with the gear.

6. The system of claim 5, wherein the rack includes latch teeth on a latch side of the rack.

7. The system of claim 4, further comprising a rod configured to be connected to the buttpad and move with the rack.

8. The system of claim 7, further comprising a stopping block disposed within the mounting box and attached to the mounting box.

9. The system of claim 8, wherein the gear is biased to urge the rack to the extended position by a constant force spring mounted to the stopping block.

10. The system of claim 8, wherein the rod and/or the rack form a catch interface configured to catch the stopping block to limit extension of the buttpad.

11. The system of claim 10, wherein the rod and rack are connected at a distal end to form the catch interface.

12. The system of claim 7, further comprising a mounting plate configured to enclose the mounting box and/or guide the rack and/or rod.

13. The system of claim 1, further comprising:
- an actuator; and
- a latch configured to be actuated by the actuator to move between a latched position engaged with the rack and pinion assembly to hold the rack and pinion assembly, and an unlatched position disengaged from the rack and pinion assembly.

14. The system of claim 13, wherein the actuator is connected to a connector member configured to transfer force from the actuator, wherein the stock defines a connector member channel, wherein the connector member is disposed within and/or travels inside the connector member channel within the stock to operatively connect to the latch.

15. The system of claim 14, wherein the latch includes a latch assembly comprising a first member configured to be moved by the connector member, and a second member configured to move relative to the first member between a latched position engaged with the rack and pinion assembly, and a second position disengaged from the rack and pinion assembly.

16. The system of claim 1, wherein the stock is a fixed stock for a long rifle and/or includes a curved shape and a rear portion.

17. The system of claim 13, wherein the actuator is positioned such that the user can actuate the actuator with a digit without removing the users hand from the device to which the stock system is mounted.

18. A firearm, comprising:
- a trigger assembly; and
- a stock system connected to the trigger assembly, the stock system comprising:
  - a stock;
  - a moveable assembly within the stock that has one or more moveable components configured to move relative to the stock, the moveable assembly comprising a rack and pinion assembly configured to bias a buttpad toward an extended position;
- wherein the rack and pinion assembly includes:
  - a rack connected, directly or indirectly, to the buttpad; and
  - a gear meshed with the rack to linearly move the rack towards the extended position with rotation of the gear, wherein at least one of the gear or the rack are biased to actuate a buttpad toward the extended position.

19. The firearm of claim 18, wherein the stock is single piece fixed stock mounted to the trigger assembly.

20. A device, comprising:
- a trigger assembly; and
- a stock system connected to the trigger assembly, the stock system comprising:
  - a stock; and
  - a moveable assembly within the stock that has one or more moveable components configured to move relative to the stock, the moveable assembly comprising a rack and pinion assembly configured to bias a buttpad toward an extended position;
- wherein the rack and pinion assembly includes:
  - a gear configured to meshed with a rack of the rack and pinion assembly to actuate movement of the rack with rotation of the gear, wherein at least one of the gear or the rack are biased to actuate a buttpad toward the extended position by at least a constant force spring.

* * * * *